US006884024B2

(12) United States Patent
Boeck et al.

(10) Patent No.: US 6,884,024 B2
(45) Date of Patent: Apr. 26, 2005

(54) ARRANGEMENT FOR THE FASTENING OF STRUTS SERVING AS BEARING CARRIERS FOR THE ROTOR OF AN AERONAUTICAL GAS TURBINE TO THE CASING STRUCTURE OF THE AERONAUTICAL GAS TURBINE

(75) Inventors: Alexander Boeck, Kottgeisering (DE); Robert Dietrich, Munich (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 10/395,950

(22) Filed: Mar. 24, 2003

(65) Prior Publication Data

US 2003/0185671 A1 Oct. 2, 2003

(30) Foreign Application Priority Data

Mar. 26, 2002 (DE) ..... 102 13 402

(51) Int. Cl.[7] ..... F01D 25/16
(52) U.S. Cl. ..... 415/142; 415/229
(58) Field of Search ..... 415/142, 229, 415/209.2, 209.3, 209.4, 189, 190

(56) References Cited

U.S. PATENT DOCUMENTS

| | | | | | |
|---|---|---|---|---|---|
| 4,369,016 | A | * | 1/1983 | Dennison | 415/142 |
| 5,236,303 | A | | 8/1993 | Fowler et al. | |
| 5,320,484 | A | | 6/1994 | Charbonnel et al. | |
| 6,358,001 | B1 | * | 3/2002 | Bosel et al. | 415/142 |

FOREIGN PATENT DOCUMENTS

| | | | | | |
|---|---|---|---|---|---|
| FR | 2321616 | A | * | 3/1977 | 415/189 |
| JP | 52-68609 | A | * | 6/1977 | 415/189 |

* cited by examiner

*Primary Examiner*—Christopher Verdier
(74) *Attorney, Agent, or Firm*—Kenyon & Kenyon

(57) ABSTRACT

An arrangement for the releasable fastening of struts serving as bearing carriers for the rotor of an aeronautical gas turbine to the casing structure of the aeronautical gas turbine, with stop faces, arranged in the circumferential direction and in the axial direction of the rotor of the gas turbine, at that end of the strut which faces away and acts as a connection head, the stop faces being assigned matching stop faces on the casing structure of the aeronautical gas turbine, and with a screw connection, inclined at an angle, between the casing structure and the connection head of the strut, for the purpose of the positive and non-positive retention of the strut on the casing structure.

11 Claims, 1 Drawing Sheet

Fig. 1
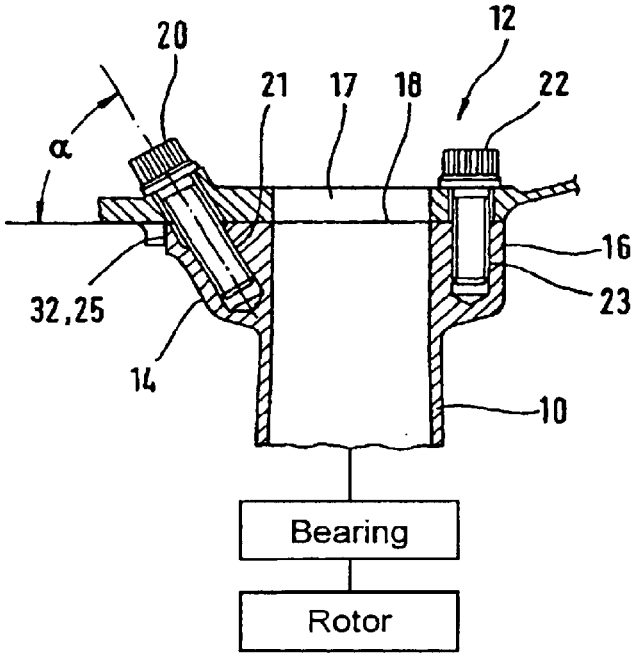
Fig. 2
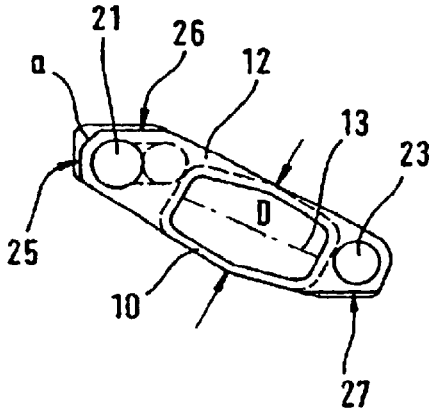
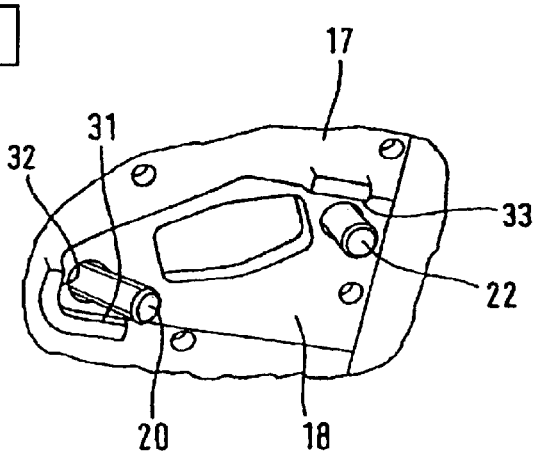
Fig. 3

ARRANGEMENT FOR THE FASTENING OF STRUTS SERVING AS BEARING CARRIERS FOR THE ROTOR OF AN AERONAUTICAL GAS TURBINE TO THE CASING STRUCTURE OF THE AERONAUTICAL GAS TURBINE

CROSS-REFERENCE TO RELATED APPLICATIONS

The present application claims priority to Application No. 102 13 402.2, filed in the Federal Republic of Germany on Mar. 26, 2002, which is expressly incorporated herein in its entirety by reference thereto.

FIELD OF THE INVENTION

The present invention relates to an arrangement for the fastening of struts serving as bearing carriers for the rotor of an aeronautical gas turbine to the casing structure of the aeronautical gas turbine.

BACKGROUND INFORMATION

As is conventional, the rotor of an aeronautical gas turbine which, as a rule, includes a compressor, combustion chamber and turbine is mounted rotatably by a plurality of bearings which are fastened to the casing structure and of which one bearing is located in the hot region downstream of the turbine. This is carried out, in this region, by suitably shaped struts, so as not to block the gas duct. The struts have a streamlined cladding in order to keep flow losses low and to protect these in turn against the influence of excessively high temperatures.

The fastening of such struts takes place in a conventional manner via screw connections, the struts being positioned fixedly via additional cantering. This purpose is served by bushes integrated into the screw connection or else by pins arranged next to the screw connection. In both cases, at the location of the connection between the struts and casing structure, for the purpose of receiving the cantering elements, the strut must be made thicker than would be necessary for a cantering-free screw connection. This thickening determines the width of the strut cladding, since the latter has to be pushed over this point of the strut during assembly.

Proceeding from the fact that slender struts with surrounding cladding bring about a lower loss of flow in the gas duct than thick struts, it is an object of the present invention to provide an arrangement for the fastening of such struts to the casing structure of the aeronautical gas turbine, the arrangement allowing a minimum thickness of the strut cladding, along with a maximum strut diameter.

SUMMARY

The above and other beneficial objects of the present invention may be achieved by providing an arrangement for the fastening of struts serving as bearing carriers for the rotor of an aeronautical gas turbine to the casing structure of the aeronautical gas turbine as described herein.

Further features and aspects of the present invention are described below.

By virtue of the arrangement according to an example embodiment of the present invention of the configuration for cantering and fastening the struts as stop faces, arranged in the circumferential direction and in the axial direction of the rotor, at those ends of the struts which face away from the rotor bearing, and as matching stop faces on the casing structure of the aeronautical gas turbine, and by virtue of the arrangement of a screw connection, inclined at an angle to the parting plane between the casing structure and the end face of the strut, for fastening the strut to the casing structure, the strut is held positively and non-positively in the predetermined position by, e.g., a simple arrangement and, at the same time, the strut is fastened to the casing structure.

In this manner, the conventional pins or bushes for cantering the struts may be eliminated, and the space acquired thereby may be utilized to give the strut cladding a more slender configuration, thus leading to an enlargement of the effective throughput orifice of the aeronautical gas turbine and consequently increasing the overall efficiency of the latter.

According to an example embodiment of the present invention, an arrangement for fastening struts serving as bearing carriers for a bearing of a rotor of an aeronautical gas turbine and surrounded by a cladding providing an undivided flow profile to a casing structure of the aeronautical gas turbine, includes: a first stop face arranged in a circumferential direction of the rotor and arranged at an end face facing away from the rotor bearing; a second stop face arranged in an axial direction of the rotor and arranged at the end face facing away from the rotor bearing; a third stop face arranged on the casing structure of the aeronautical gas turbine assigned to and matching the first stop face; a fourth stop face arranged on the casing structure of the aeronautical gas turbine assigned to and matching the second stop face; and at least one screw connection inclined at an angle to a parting plane between the casing structure and the end face and configured to hold at least two of the stop faces in bearing contact and to releasably fasten the strut to the casing structure.

The end face may include a connection head of the strut.

A longitudinal axis of the inclined screw connection may intersect at an angle of approximately 30° the parting plane between the end face and the casing structure.

The screw connection may be arranged approximately in a longitudinal plane of the strut.

The first and second stop faces assigned to the strut may form an angle of 90° and may be separated from one another by a free space.

The third and fourth stop faces assigned to the casing structure may be part of an angle piece including legs that form an angle of 90°.

The end face of the strut that faces away from the rotor bearing may include a flange-shaped bearing head which, in cross section, may be approximately symmetrical to a longitudinal plane of the strut and which may merge into projections arranged symmetrically to the longitudinal plane and do not project beyond a thickness of the strut, at least one projection forming part of the screw connection.

The arrangement may include a second screw connection extending parallel to a plane of symmetry of the strut.

The second screw connection may be assigned a fifth stop face arranged to act in the circumferential direction of the rotor and matched with a sixth stop face assigned to the casing structure.

The at least two stops held in bearing contact may be configured to engage each other in a positive-locked manner.

The at least one screw connection may be configured to press together the strut and at least one of the third stop face and the fourth stop face.

The present invention is described below with reference to an exemplary embodiment illustrated more or less schematically in the drawings.

BRIEF DESCRIPTION OF THE DRAWINGS

FIG. 1 is a longitudinal cross-sectional view through the region of the fastening configuration of an arrangement according to an example embodiment of the present invention for fastening a strut serving for mounting the rotor of an aeronautical gas turbine to the casing structure of the aeronautical gas turbine.

FIG. 2 is a top view of that end face of the strut illustrated in FIG. 1 which faces away from the bearing point of the rotor.

FIG. 3 is a bottom view of the casing structure of the aeronautical gas turbine which forms a parting plane between the casing structure and the end face of the strut illustrated in FIG. 1.

DETAILED DESCRIPTION

A strut 10, illustrated only partially in FIG. 1 and serving as a bearing carrier for the rotor of an aeronautical gas turbine has, at the end facing away from the rotor, a web-shaped connecting head 12 serving as a flange. The strut itself, if appropriate of hollow configuration, is arranged, in cross-section, as an extremely flat hexagon which is arranged symmetrically to the longitudinal plane 13 and beyond the narrow sides of which the web-shaped connection head projects in the form of projections 14 and 16; cf. also FIG. 2. As a result, only the depth of the strut 10, but not its thickness D, is increased in this region.

The plane faces confronting one another, e.g., that of a casing structure 17 of the casing of the aeronautical gas turbine and the end face of the connection head 12, form a parting plane 18 between the casing structure 17 and the strut 10.

The projections 14 and 16 are in each case part of a screw connection 20/21 and 22/23 which include in each case of a screw 20 and 22 and of a matching screw thread 21 and 23. The screw connection 20/21 is inclined to the parting plane 18 by the angle $\alpha$, and the screw connection 22/23 is arranged perpendicularly to the parting plane 18; cf., e.g., FIG. 1.

The projections of the connection head 12 are provided with stop faces 25, 26 and 27 extending at right angles to the parting plane 18, the projection 14 being assigned stop faces 25 and 26 and the projection 16 being assigned the stop face 27. The stop faces 25 and 26 of the connection head 12 are arranged at right angles to one another and are separated from one another by a free space a. These stop faces match with stops 31/32 and 33 which are arranged on the casing structure 17 and of which the stops 31 and 33 are assigned to the circumferential direction and the stop 32 to the axial direction of the rotor.

Claddings, which are assigned to the struts 10 and provide an undivided flow profile, and which are slipped onto the struts radially from outside during assembly, are provided.

By the stops 31 and 32, each strut 10, when being connected to the casing structure 17, is brought to bear against the stop faces 25 and 26 of its connection head 12 and is fixed positively in this position in the circumferential direction and in the axial direction with respect to the rotor. The securing of the strut counter to the action of the stops 25/26 and 31/32 takes place non-positively by the screw connection 20/21 inclined at the angle a to the parting plane 18. By virtue of this inclined or angled arrangement of the screw connection, a force component which presses the strut against the stop 32 is obtained. The strut 10 is consequently secured positively and non-positively in all directions to the casing structure 17 of the casing of the aeronautical gas turbine.

The above-described second screw connection 22/23, which, however, may, in principle, be dispensed with, serves for the purpose of the additional connection of the strut to the casing structure.

The angle $\alpha$ may amount to 30° and may be selected freely within a wide range, as long as the non-positive securing of the strut at the stops 31/32 may be ensured. Also, the axis of the screw connection 20/21 may not have to be arranged in the plane of symmetry of the engine axis. A rotation of this axis in the direction of the symmetrical longitudinal plane 13 of the strut 10 may provide the result that the axial pressure force resulting from the prestress is also partially diverted to the stop faces 26/31 arranged in the circumferential direction, thus also resulting in, e.g., better cantering.

Other changes to the configuration of the fastening arrangement described which are within the scope of the present invention are also possible, for example, an inclination of the parting plane (18) with respect to the engine axis as regards convergent or divergent casings.

What is claimed is:

1. An arrangement for fastening struts serving as bearing carriers for a bearing of a rotor of an aeronautical gas turbine to a casing structure of the aeronautical gas turbine, comprising:

a first stop face arranged in a circumferential direction of the rotor and arranged at an end face facing away from the rotor bearing;

a second stop face arranged in an axial direction of the rotor and arranged at the end face facing away from the rotor bearing;

a third stop face arranged on the casing structure of the aeronautical gas turbine assigned to and matching the first stop face;

a fourth stop face arranged on the casing structure of the aeronautical gas turbine assigned to and matching the second stop face; and at least one screw connection inclined at an angle to a parting plane between the casing structure and the end face and configured to hold at least two of the stop faces in bearing contact and to releasably fasten the strut to the casing structure.

2. The arrangement according to claim 1, wherein the end face includes a connection head of the strut.

3. The arrangement according to claim 1, wherein a longitudinal axis of the inclined screw connection intersects at an angle of approximately 30° the parting plane between the end face and the casing structure.

4. The arrangement according to claim 1, wherein the screw connection is arranged approximately in a longitudinal plane of the strut.

5. The arrangement according to claim 1, wherein the first and second stop faces assigned to the strut form an angle of 90° and are separated from one another by a free space.

6. The arrangement according to claim 1, wherein the third and fourth stop faces assigned to the casing structure are part of an angle piece including legs that form an angle of 90°.

7. The arrangement according to claim , wherein the end face of the strut that faces away from the rotor bearing includes a flange-shaped bearing head which, in cross section, is approximately symmetrical to a longitudinal plane of the strut and which merges into projections arranged symmetrically to the longitudinal plane and do not project beyond a thickness of the strut, at least one projection forming part of the screw connection.

8. The arrangement according to claim 1, further comprising a second screw connection extending parallel to a plane of symmetry of the strut.

9. The arrangement according to claim 8, wherein the second screw connection is assigned a fifth stop face arranged to act in the circumferential direction of the rotor and matched with a sixth stop face assigned to the casing structure.

10. The arrangement according to claim 1, wherein the at least two stops held in bearing contact are configured to engage each other in a positive-locked manner.

11. The arrangement according to claim 1, wherein the at least one screw connection is configured to press together the strut and at least one of the third stop face and the fourth stop face.

* * * * *

UNITED STATES PATENT AND TRADEMARK OFFICE

CERTIFICATE OF CORRECTION

PATENT NO. : 6,884,024 B2
DATED : April 26, 2005
INVENTOR(S) : Boeck et al.

It is certified that error appears in the above-identified patent and that said Letters Patent is hereby corrected as shown below:

Column 4,
Line 66, change "according to claim," to -- according to claim 1, --.

Signed and Sealed this

Tenth Day of January, 2006

JON W. DUDAS
*Director of the United States Patent and Trademark Office*